United States Patent [19]

Simjian

[11] Patent Number: 4,557,520

[45] Date of Patent: Dec. 10, 1985

[54] CHAIR WITH MOVING SEAT AND MOVING MIRROR

[75] Inventor: Luther G. Simjian, Fort Lauderdale, Fla.

[73] Assignee: Command Automation, Inc., Fort Lauderdale, Fla.

[21] Appl. No.: 651,756

[22] Filed: Sep. 18, 1984

[51] Int. Cl.[4] ..... A47C 7/62

[52] U.S. Cl. ..... 297/185; 297/349

[58] Field of Search ..... 297/185, 349, 240, 241, 297/242; 108/103, 134; 248/425; 350/617, 618, 621, 623, 626, 639

[56] References Cited

U.S. PATENT DOCUMENTS

| | | | |
|---|---|---|---|
| 826,917 | 7/1906 | Bedell | 297/349 |
| 2,192,159 | 2/1940 | Simjian | 350/639 X |
| 2,275,304 | 3/1942 | Maurud | 350/621 |
| 2,510,351 | 6/1950 | Simjian | 297/185 X |
| 2,648,579 | 8/1953 | Slyter et al. | 297/349 X |
| 2,811,083 | 10/1957 | Simjian | 297/185 X |
| 3,637,185 | 1/1972 | Miicos et al. | 248/425 |
| 3,806,189 | 4/1974 | Simjian | 297/185 |
| 3,834,660 | 9/1974 | Leffler | 248/425 X |
| 3,905,642 | 9/1975 | Simjian | 297/185 |

FOREIGN PATENT DOCUMENTS

| | | | |
|---|---|---|---|
| 512911 | 9/1939 | United Kingdom | 350/621 |

*Primary Examiner*—William E. Lyddane
*Assistant Examiner*—José V. Chen

[57] ABSTRACT

A chair construction in which a rotating seat causes counter rotation of a mirror secured to an arm extending upwardly from underneath the seat. Cam means disposed in the rotating mechanism of the seat retain the face of the mirror during rotation of the seat tangential to a circle having its center forward of the center of rotation of the seat. The angular adjustment of the mirror face is transmitted from the cam means and a flexible shaft to a rotatably mounted post, forming a part of the upstanding arm, to which the mirror is secured.

6 Claims, 8 Drawing Figures

CHAIR WITH MOVING SEAT AND MOVING MIRROR

BRIEF SUMMARY OF THE INVENTION

This invention is related to a chair construction having a mirror mounted for movement with the seat of the chair in a coordinated manner. Chairs of this type have been disclosed by me previously in U.S. Pat. Nos. 2,218,301; 2,218,302; 2,510,351; 2,811,083; 2,897,727; 3,806,189 and 3,905,642.

These patents reveal a chair construction in which a rotating seat is adapted to cause rotation of a mirror carried by the chair so that a person occupying the seat of the chair may adjust the mirror relatively to a stationary cooperating mirror. The stationary mirror, usually the mirror of a dresser or a mirror mounted against the wall in front of the chair, reflects an image from the rear and the side of the person occupying the chair and, hence, by the cooperation of both mirrors, the person on the chair may view the hair and clothing at the rear or side, which views are normally not seen by the person. In this manner, hair and clothing can readily be adjusted.

The present invention concerns a chair construction in which further simplifications have been achieved with a view of providing a kit which can be sent through the mail and assembled by the recipient. In addition, the cost of producing such a unit has been reduced by a simplification of the individual parts, thus making the kit and chair available to a greater number of purchasers. In line with this aim, the present invention discloses individual components which in combination produce a new and unique chair construction which is not only inexpensive to manufacture, but the individual components are light for shipment, yet when assembled provide a most sturdy and rugged chair assembly, well-adapted to support a person.

I have thus outlined broadly the more important features of my invention in order that the detailed description thereof which follows may be better understood, and in order that my contributions to the art may be better appreciated. There are, of course, additional features of my invention which will be described hereafter and which will form the subject of claims appended hereto. Those skilled in the art will appreciate that the concept on which my disclosure is based may readily be utilized as a basis for designing of other structures for carrying out the several purposes of my invention. It is important, therefore, that the claims be regarded as including such equivalent constructions as do not depart from the spirit and scope of my invention.

DETAILED DESCRIPTION OF THE PREFERRED EMBODIMENT

Figure 1:
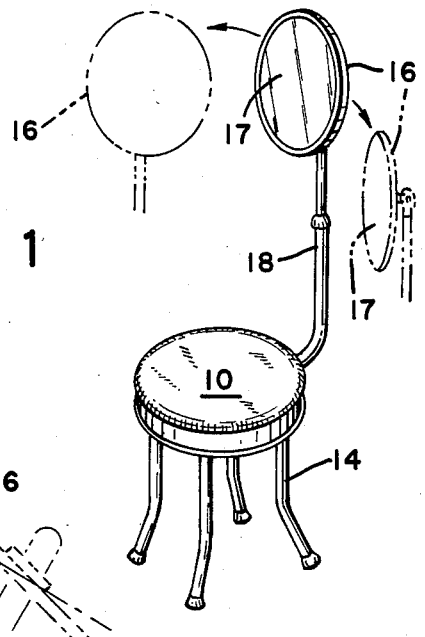
FIG. 1 is a perspective view of the assembled chair with mirror.
Figure 2:
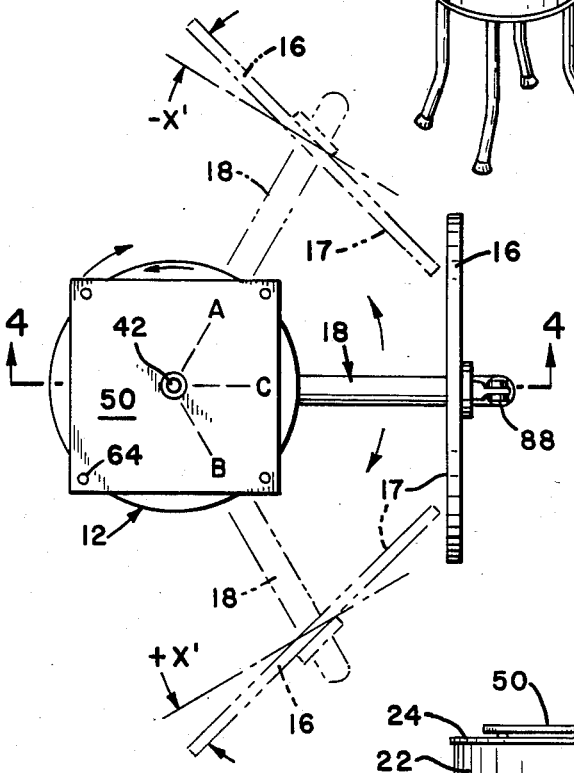
FIG. 2 is a plan view of the chair with seat cushion removed to show some of the constructional features of the present invention.
Figure 3:
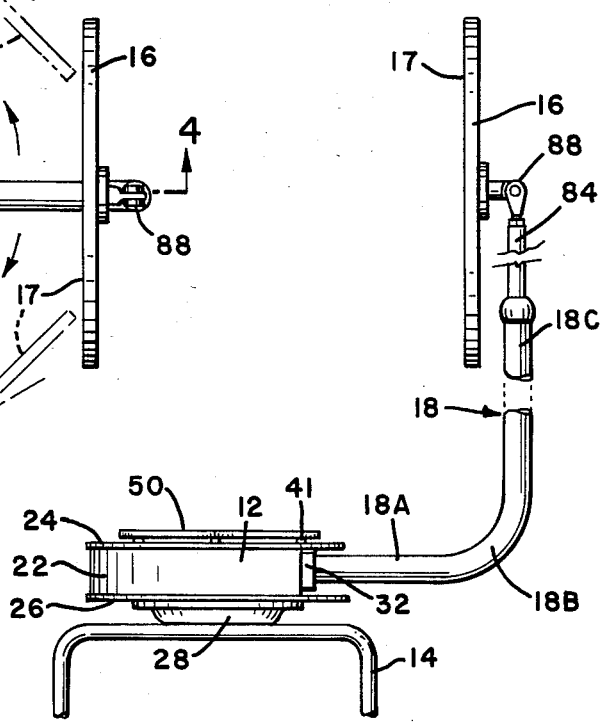
FIG. 3 is a side elevational view of the chair with the seat cushion removed.

Referring now to the figures and FIGS. 1 through 3 in particular, there is illustrated, a chair comprising a seat 10 mounted upon a rotatable mechanism 12 which, in turn, is supported on suitable legs 14. A mirror 16 having a reflecting surface 17 is supported above the seat 10 by a vertical arm 18 for cooperating with a stationary vertically mounted mirror disposed in front of the chair, such as the mirror of a dresser. The mirror arm 18 at its lower end includes a horizontal portion 18A which is attached to the rotatable mechanism 12, FIG. 3, beneath the seat 10. As the seat 10 is caused to rotate, the arm 18 with mirror 16 is driven in counterrotation as is indicated by the dashed lines in FIG. 1. The rotation of the seat and arm is normally limited, the amount of rotation permitted being selected arbitrarily and restricted typically to less than 180 degrees. The precise mechanisms for accomplishing the various functions will be described hereafter.

Figure 6C:
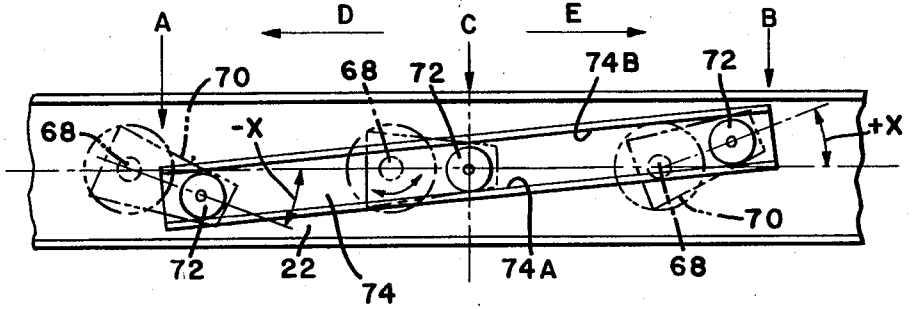
FIG. 6C is a developed view schematically showing the operation of the cam and cam follower causing the angle of the mirror to be changed as the mirror arm and mirror rotate about the seat.
Figure 4:
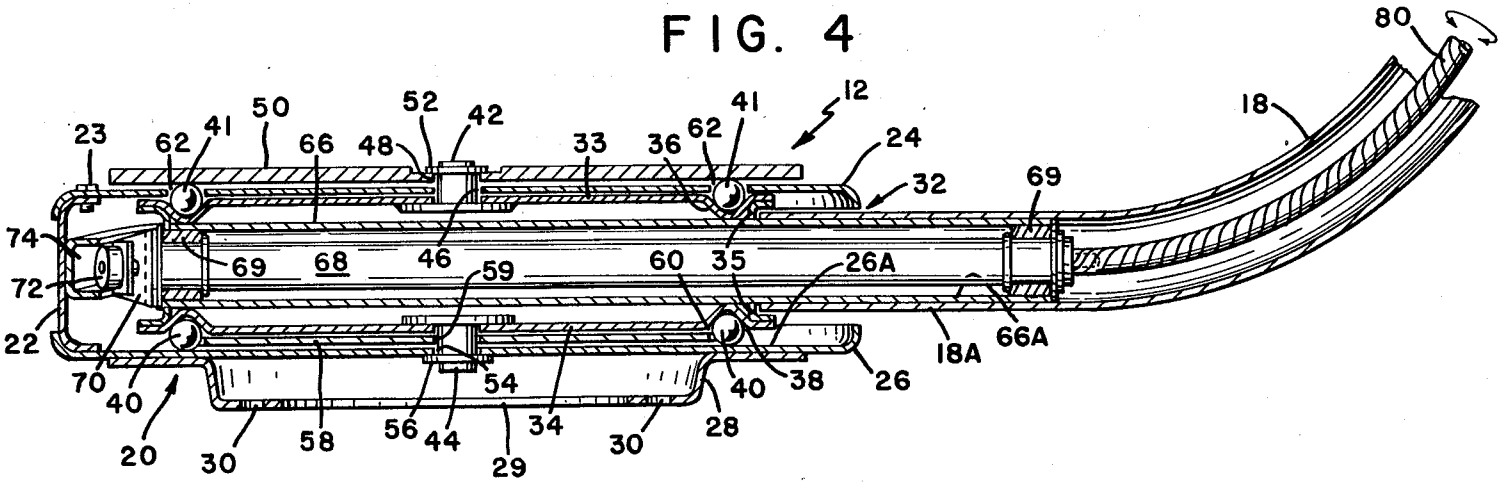
FIG. 4 is a sectional view taken along line 4—4 in FIG. 2.
Figure 6B:
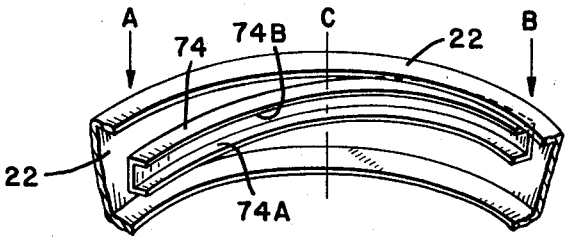
FIG. 6B is a fragmentary sectional view taken along line 6B—6B of FIG. 6A illustrating the cam track arrangement.
Figure 6A:
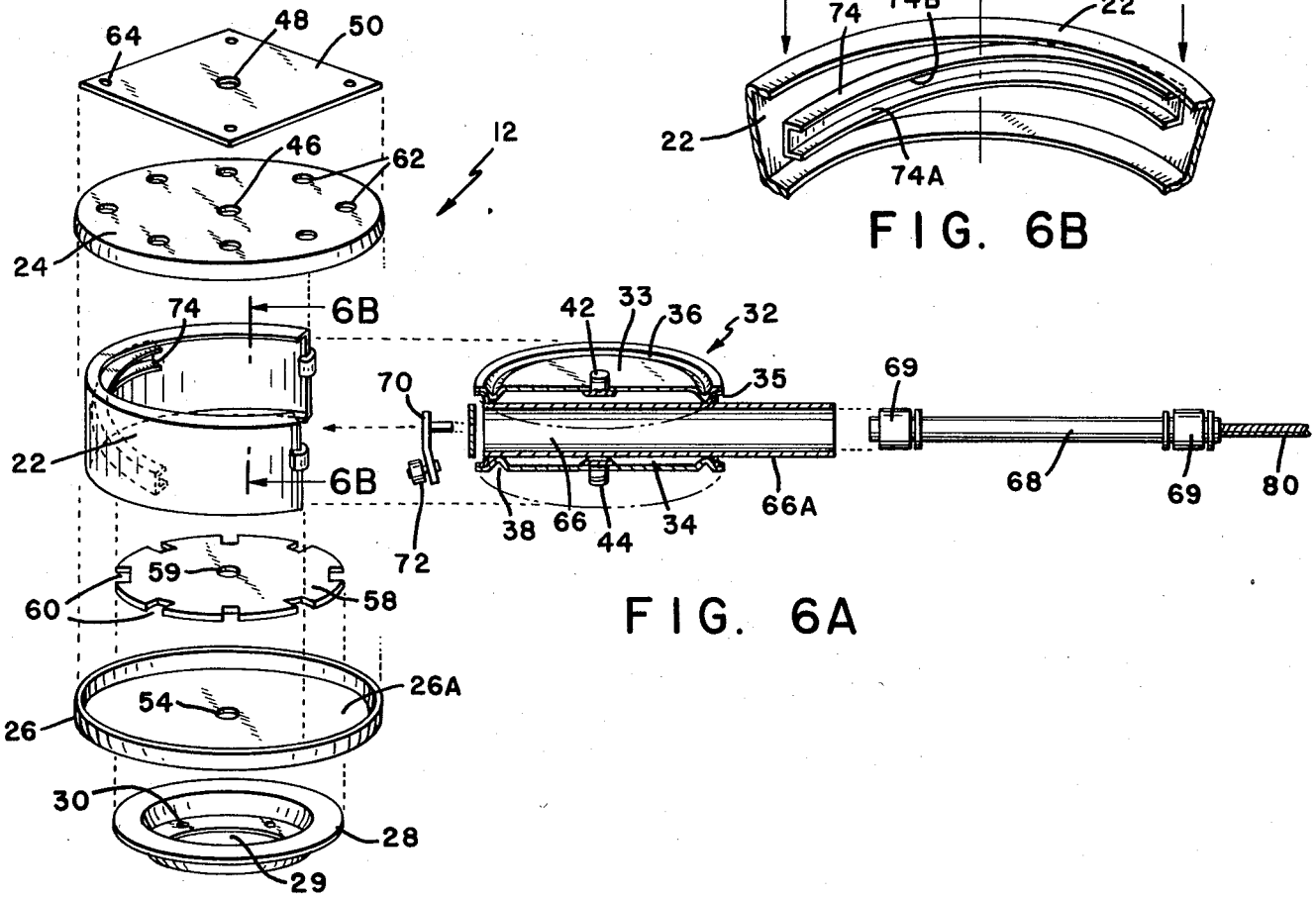
FIG. 6A is an exploded view showing the rotatable mechanism for the chair seat and mirror arm including a cam and cam follower mechanism for changing the angle of the mirror.

With particular reference to FIGS. 4 and 6A, the rotatable mechanism generally indicated by numeral 12 comprises a housing generally indicated by numeral 20 which includes a substantially circular channel shaped side wall 22, a circular top plate 24 secured to the side wall 22 by suitable means, such as screws 23, and a circular bottom plate 26 secured to the lower end of a side wall 22 by any suitable means, such as welding. A dish-shaped circular flange 28 having a bottom opening 29 is secured to the lower surface of the bottom plate 26 of the housing 20. Screw holes 30 are appropriately located in the bottom portion of flange 28 for securing the legs 14 as best seen in FIGS. 3 and 4. The flange 28, therefore, serves as the leg mounting plate.

An impeller drum generally identified by numeral 32 comprises a circular top plate 33, a circular bottom plate 34 secured respectively to the top and bottom edges of a circular side wall 35. The top and bottom plates 33 and 34 are formed with suitable annular grooves 36 and 38 respectively to receive therein a plurality of steel balls 40 forming a lower bearing and balls 41 forming an upper bearing. The impeller drum 32 is rotatably mounted within the housing 12 by virtue of axially aligned studs 42 and 44 which are secured to the top and bottom plates 33 and 34 respectively. The stud 42 projects upwardly through a central hole 46 of housing top plate 24 and through a central hole 48 of the seat mounting plate 50 and is secured by a snap ring 52. Similarly, the stud 44 projects downwardly through a central hole 54 in the bottom plate 26 of the housing 12 and is secured by a snap ring 56. As the impeller drum 32 pivots about the studs 42 and 44, the groove 38 in the bottom plate 34 of the drum rides on top of the steel balls 40 in the manner of a ball bearing race. The balls 40 in turn roll upon the top surface 26A of the bottom plate 26 in housing 12 and are held in spaced relationship to each other by a retaining plate 58 positioned between the housing bottom plate 26 and the drum bottom plate 34 as shown in FIG. 4. The retaining plate 58 is provided with a central hole 59 through which the stud 44 passes and includes a plurality of spaced notches 60 in its outer circumference, each of which notch receives a steel ball 40. Similarly, the upper bearing includes the steel balls 41 which run in the groove 36 of the top drum plate 33 and normally protrude through a plurality of holes 62 in the housing top plate 24 which serves to retain the balls in spaced relationship to each other. It will be noted that the seat mounting plate 50 is provided with screw hole 64 for attaching the seat 10 on its upper surface while its lower surface rests on top of the steel balls 41. It will now become apparent that when the seat mounting plate 50 is rotated about the stud 42, the balls 41 being retained by the holes 62 rotate and thereby move the impeller drum 42 in the opposite direction to that of the seat plate 50 as a result of the friction between the steel balls 41 and the drum groove 36 and the plate 50.

Figure 5:
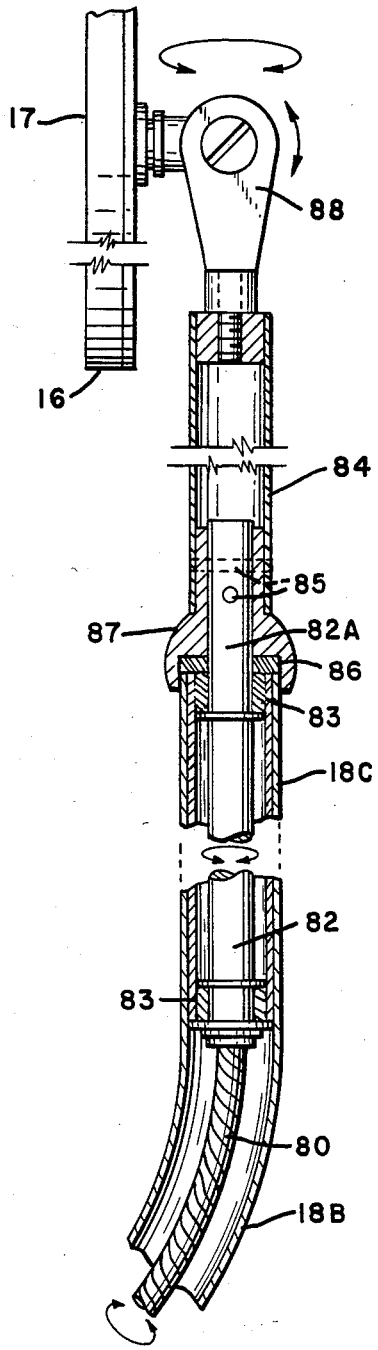
FIG. 5 is a sectional view similar to FIG. 4 showing the construction of the mirror support arm.

The arm 18 which carries the mirror 16, see FIG. 1, is attached to the impeller drum 32 and it therefore follows that responsive to the seat being rotated in one direction, the arm with mirror moves in the opposite direction. With reference to FIGS. 4 and 6A, a tube 66 is secured within the impeller drum 32, extending from one side diametrically across to and beyond the opposite side to form a protruding portion 66A upon which the mirror support arm 18 is attached. A shaft 68 is journaled for rotation within the tube 66 by bearings 69. A lever 70 is fastened to one end of the shaft 68 and carries a cam follower 72 which runs in a channel shaped cam 74 secured inside the wall 22 of the housing 12. The U-shaped cam 74 has a starting point A, FIGS. 6B and 6C, which is adjacent to the lower edge of the wall 22 and rises along the wall to its end position B adjacent the upper edge of the wall. It will become apparent that when the impeller drum 32 moves counter-clockwise or in the direction of arrow D, FIG. 6C from its central position C to position A, the shaft 68 will be rotated through an angular displacement $-x$ due to the motion of the cam follower 72 cooperating with the cam surfaces 74A and 74B. Conversely, when the impeller drum 32 is rotated in a clockwise direction or in direction of arrow E, the shaft 68 will be rotated through an angular displacement $+x$. Rotational movement of the shaft 68 is transmitted to the mirror 16 through a flexible shaft 80, a rod 82 and a support post 84 as best shown in FIGS. 4 and 5. Thus, the angular displacement $+x$ and $-x$ caused by the inclined cam 74 and cam follower 72, produces resultant angular displacements of $+x'$ and $-x'$ respectively of the mirror 16 as illustrated in FIG. 2.

This angular motion of the mirror 16 is required in order to cause a substantially stationary reflection of the image from behind the head of a person sitting on the chair to appear on the mirror disposed in front of the seat 10 (and certainly in front of the axis of rotation of the seat 10) as the person causes by rotation of the seat 10 the mirror 16 to swing from one side to the other. It will be noted that the mirror support arm 18 is a hollow tube having a horizontal portion 18A which attaches in a telescopic manner over the protruding portion 66A of the drum 32 and is secured in any suitable manner (not shown). An arcuate portion 18B of the support arm 18 connects portion 18A to a vertical portion 18C. The flexible shaft 80 (obtainable typically from GBG Industries, Inc., Willimantic, CT 06226) is carried within the tube 18 and connects at one end to the free end of the shaft 68 and extends through the arcuate portion 18B to connect to the lower end of the rod 82 which is rotatably carried by bearings 83 within the portion 18C of the arm 18. The rod 82 has an upwardly projecting portion 82A which protrudes beyond the tube 18C and is secured by pins 85 to the lower end of the support post 84 to transmit the rotary motion from the rod 82 to the post 84. A thrust bearing 86 is carried in the lower end 87 of the post 84 to facilitate ease of operation. A mirror mount including a swivel joint 88 is mounted on the top end of the post 84 and carries the mirror 16 in a manner to permit manual pivotal adjustment of the mirror relative to the vertical axis.

Therefore, it will be noted that a person sitting on the chair and causing the seat 10 to rotate, effects counterrotation of the arm 18 and mirror 16, and as the mirror rotates with the arm, the mirror itself is pivoted in a prescribed angular adjustment about a substantially vertical axis from a central position C to $+x'$ or $-x'$, respectively. Expressed otherwise, the angular adjustment of the mirror provided by the cam 74, cam follower 72, and rotatable shafts 68, 80, 82 and 84 is such that the face 17 of the mirror 16 is retained substantially tangential to a substantially horizontally disposed circle having its center located foward of the axis of rotation of the seat as the seat and mirror arm undergo rotational motion. Preferably, the center of the circle is in front of the seat and substantially coincident with the plane of the stationary mirror disposed in front of the chair.

What is claimed is:

1. A chair comprising:

a rotatable mechanism including at its top a rotatable seat mounting plate, at its bottom a stationary leg mounting plate, a rotatably mounted impeller drum disposed between said seat mounting plate and said leg mounting plate for causing responsive to said seat mounting plate being rotated in one direction said drum to be rotated in the opposite direction;

a mirror support arm secured with one end to said drum for motion therewith, said arm radially extending from said rum underneath said seat mounting plate rearwardly thereof into an upwardly curved portion and continuing in a vertically direction portion, and including at its upper end a mirror mounting means for securing thereto a mirror adapted to be driven in angular motion about a substantially vertical axis;

a cam, and cam follower means including a flexible shaft one end of said shaft connected to said mirror mounting means and the other end of said shaft connected to said cam follower means, for coupling said drum to said mirror mounting means for causing, responsive to the rotation of said seat mounting plate and concomitant counterrotation of said arm, the face of a mirror mounted to said mirror mounting means to be moved for assuming a position substantially tangential to a circle having its center located forward of the axis of rotation of said seat mounting plate, said cam being of channel shaped configuration and secured inside the wall of said drum and disposed at an angle to rise from a position adjacent to the lower edge of said wall to a position adjacent to the upper edge of said wall, and said cam follower engaging said channel shaped cam and causing rotation of said flexible shaft in response to rotation of said drum.

2. A chair as set forth in claim 1 and including bearing means disposed between said impeller drum and said seat mounting plate and said impeller drum and said leg mounting plate respectively.

3. A chair as set forth in claim 1, said flexible shaft being disposed within the curved portion of said arm.

4. A chair comprising:

a rotatable seat;

a set of legs upholding said seat;

a rotating mechanism disposed between said seat and said legs and including a rotatably mounted impeller drum for causing, responsive to said seat being rotated in one direction, said drum to be rotated in the opposite direction;

a mirror support arm secured with one end to said drum for motion therewith, said arm radially extending from said drum underneath said seat in a generally horizontal direction toward the rear of said seat, then extending into an upwardly curved portion and continuing in a vertically directed portion and terminating with its other end at a position above said seat;

a mirror adapted to be mounted along a substantially vertical plane to said other end of said arm;

mirror mount means coacting between said arm and said mirror for pivotally adjusting said mirror relative to said vertical plane;

means which include a cam, a cam follower and a flexible shaft disposed for coupling the motion of said drum to said mirror for causing responsive to the rotation of said seat and concomitant counterrotation of said arm the face of the mirror to be driven in angular motion about a substantially vertical axis for assuming a position substantially tangential to a circle having its center located forward of the axis of rotation of said seat;

said cam being of channel shaped configuration and secured inside the wall of said drum and being disposed at an angle to rise from a position adjacent to the lower edge of said wall to a position adjacent to the upper edge of said wall;

said cam follower engaging said cam and being coupled to rotating shaft means which include said flexibe shaft, and said rotating shaft means disposed at least partially inside said arm and coupled to said mirror mount means for effecting the motion of said mirror about a substantially vertical axis.

5. A chair as set forth in claim 4, said flexible shaft being disposed within said curved portion of said arm and being mounted for transmitting rotation relative to said arm.

6. A chair comprising:

a rotatable mechanism including at its top a rotatable seat mounting plate, at its bottom a stationary leg mounting plate, a rotatably mounted impeller drum disposed between said seat mounting plate and said leg mounting plate for causing responsive to said seat mounting plate being rotated in one direction said drum to be rotated in the opposite direction;

a mirror support arm secured with one end to said drum for motion therewith, said arm radially extending from said drum underneath said seating mounting plate rearwardly thereof into an upwardly directed portion and continuing in a vertically directed portion, and including at its upper end a mirror mounting means for securing thereto a mirror adapted to be driven in angular motion about a substantially vertical axis;

means which include a cam, a cam follower and a flexible shaft coupling said drum to said mirror mounting means for causing, responsive to the rotation of said seat mounting plate and concomitant counterrotation of said arm, the face of a mirror mounted to said mirror mounting means to be moved for assuming a position substantially tangential to a circle having its center located forward of the axis of rotation of said seat mounting plate, said cam follower connected to one end of said shaft, the other end of said shaft connected to said mirror mounting means, and said cam secured to said drum and positioned thereupon for causing said cam follower engaging said cam to provide rotation of said flexible shaft coupled to said cam follower in response to rotation of said drum.

* * * * *